United States Patent [19]

Face, Jr.

[11] 4,133,072

[45] Jan. 9, 1979

[54] DEVICE FOR REMOVING WATER FROM LARGE FLOOR SURFACES

[76] Inventor: Samuel A. Face, Jr., P.O. Box 6341, Norfolk, Va. 23508

[21] Appl. No.: 773,150

[22] Filed: Mar. 1, 1977

[51] Int. Cl.[2] ..... A47L 5/34

[52] U.S. Cl. ..... 15/353; 15/401

[58] Field of Search ..... 15/320, 321, 322, 353, 15/401

[56] References Cited

U.S. PATENT DOCUMENTS

| | | | |
|---|---|---|---|
| 716,312 | 12/1902 | Thurman | 15/353 |
| 2,731,103 | 1/1956 | Ortega | 15/321 X |
| 2,909,800 | 10/1959 | Grindle et al. | 15/353 X |
| 3,131,417 | 5/1964 | Compton, Jr. | 15/353 |
| 3,797,065 | 3/1974 | Hughes | 15/353 |
| 3,840,935 | 10/1974 | Fitzgerald et al. | 15/322 |
| 3,940,826 | 3/1976 | Phillips et al. | 15/353 X |
| 4,041,569 | 8/1977 | Petersen | 15/353 |

*Primary Examiner*—Christopher K. Moore
*Attorney, Agent, or Firm*—Clarence A. O'Brien; Harvey B. Jacobson

[57] ABSTRACT

Floor or other large surface drying apparatus characterized by efficient placement and use within the apparatus of both a vacuum pump and a water pump preferably powered by one prime mover geared to drive both pumps at different speeds. Vacuum produced by the vacuum pump entrains an air/water mixture and directs said mixture into a plenum chamber disposed in the lowermost portion of the apparatus in order to reduce lift height to a minimum, water being separated from the mixture in the plenum chamber and by means of the water pump, discharged from the apparatus to a remote point through a discharge hose.

11 Claims, 4 Drawing Figures

24
22
10
16
26
14
74
76
12
18
20
30
32
18

54
10

22
16
26
14
74
56
52
76
15
48
12
72
46
68
60
44
58
4
4
38
42
70
40
28
50
30
34
36
66
62
64
20
32
18

DEVICE FOR REMOVING WATER FROM LARGE FLOOR SURFACES

BACKGROUND AND SUMMARY OF THE INVENTION

Drying large floors or other surfaces, such as artificial athletic playing surfaces, which have been soaked with water by washing or otherwise, requires considerable time and labor. Prior devices have been proposed such as the apparatus disclosed by Houser in U.S. Pat. No. 2,989,769. The Houser apparatus is illustrative of the teachings of the prior art in two particular ways. Firstly, water drawn from the surface being dried is caused to be stored within a tank internally of the apparatus. Such devices must, therefore, be frequently emptied, the time lost in this manual discharge process usually exceeding the time needed for each filling of the storage tank. Secondly, Houser employs a vacuum pump to draw an air/water mixture into the apparatus, the vacuum pump being of a high power rating, and, therefore, being costly, in order that the water/air mixture can be drawn to a relatively great height above the floor before separation of the water from the air occurs. Thus, expensive vacuum-producing apparatus is required to power prior art devices due to the structures and modes of operation employed previous to the present invention. The following additional U.S. patents illustrate further developments in this art:

U.S. Pat. Nos:
365,192 — June 21, 1887
434,178 — Aug. 12, 1890
1,498,255 — June 17, 1924
2,223,963 — Dec. 3, 1940
2,237,830 — Apr. 8, 1941
3,039,122 — June 19, 1962.

The present invention provides floor drying apparatus capable of removing moisture from a large surface area both quickly and efficiently. The present apparatus can be caused to operate in an unattended manner when surface elevation conditions are appropriate. Otherwise, the apparatus can be manually propelled or self-propelled over the surface area which is to be dried. The present apparatus particularly provides a floor drying apparatus wherein vacuum producing means draws a stream of air between a wet surface and a squeegee member, thereby entraining water into the air stream. The entrained water/air mixture is drawn under the influence of the vacuum-producing means into a plenum chamber disposed immediately above the entrance openings through which the mixture is brought into the apparatus. The plenum chamber is disposed within the apparatus at as low a level relative to the surface being dried as is possible in order that the relatively heavy water/air mixture need not be lifted to a height greater than is absolutely necessary. Thus, a relatively less powerful and less expensive vacuum pump can be used due to the fact that the water/air mixture is lifted only a few inches above the surface being dried. The velocity of the water-air mixture entering the plenum chamber is caused to decrease and become laminar, thereby allowing the heavier water to fall into a collection container where said water is discharged by a water pump from the apparatus, a hose channeling the water to a sump or other drain remote from the surface being dried. The vacuum pump and water pump are preferably driven by one prime mover, such as by an electric motor, which is geared to drive each of the pumps at their most efficient speeds. Thus, a vacuum pump and a water pump can be simultaneously driven by one prime mover to accomplish two separate and necessary functions at optimum efficiency, thereby allowing the use of relatively less powerful and less costly vacuum-producing means in the present apparatus.

Accordingly, it is an object of the invention to provide a floor drying apparatus of the vacuum type which is capable of efficient and rapid removal of moisture from a large surface area.

It is another object of the invention to provide a portable or self-propelled floor dryer that is inexpensive to manufacture and operate.

It is further object of the invention to provide a floor drying apparatus having a vacuum pump and a water pump driven at their most efficient relative speeds by one prime mover, the vacuum pump lifting only a few inches the water being drawn from the surface of the floor being dried.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
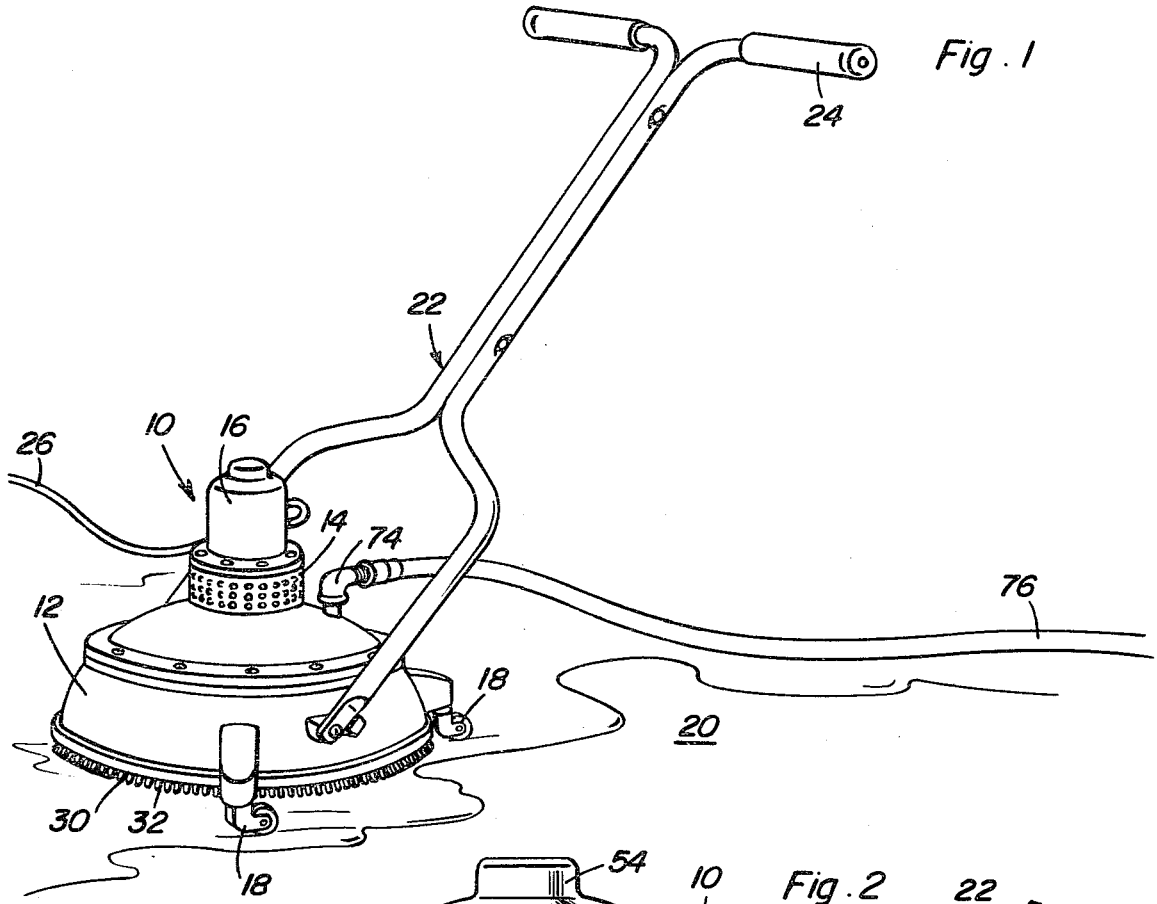
FIG. 1 is a perspective view of a manually operable embodiment of the invention.
Figure 2:
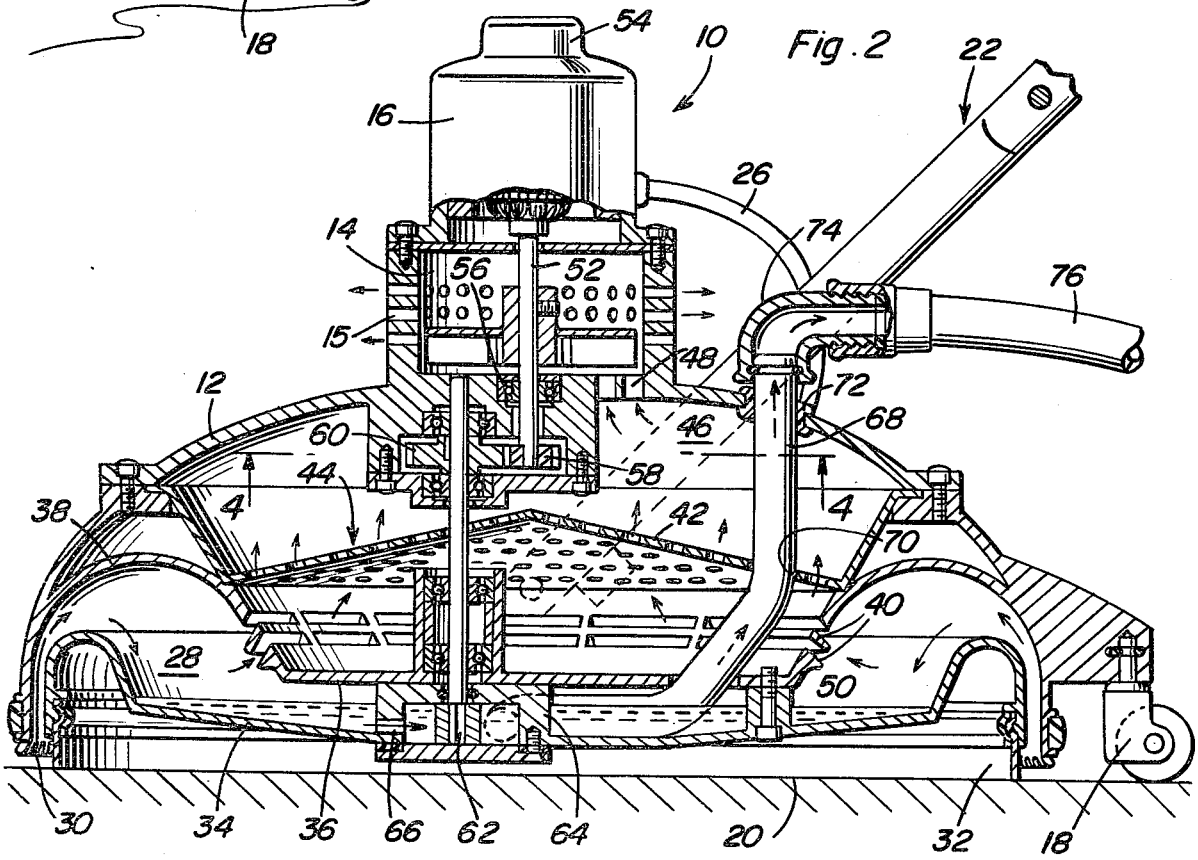
FIG. 2 is a sectional view of a portion of the apparatus of FIG. 1.

Referring now to the drawings and particularly to FIGS. 1 and 2, a manually operable embodiment of the invention can be seen at 10 to comprise a hemispherical housing shell 12 surmounted by a vacuum pump 14 and and electric motor 16. Casters 18 attached to the shell 12 contact a surface 20 which is to be dried and are adapted to be rolled thereon, the unit 10 being manually propelled over the surface 20 by means of a handle member 22. The handle member 22 can preferably be formed of two tubular members bolted together along central portions thereof, distal end portions being laterally recurved and fitted with rubber grips 24 for the convenience of a user. Basal end portions of the tubular members are pivotally attached to the exterior surface of the shell 12 at convenient sites in a well-known fashion. The electric motor 16 is seen to receive power through a conventional cord 26.

The manner by which moisture on the surface 20 is caused to be removed therefrom by the unit 10 can be more readily understood by reference to FIG. 2. The shell 12 is seen to house a plenum chamber 28 at the lower portion thereof, the plenum chamber 28 communicating with ambient through an annular perimetric nozzle opening 30 disposed immediately above the surface 20 when the unit 10 is positioned in the operative state. The nozzle opening 30 faces the surface 20 and is spaced therefrom, an annular rubber squeegee member 32 being positioned immediately adjacent the inner periphery of the opening 30, the squeegee member 32 extending downwardly from the unit 10 to contact the surface 20 along the perimetric distal edge portions of said member 32.

The plenum chamber 28 is enclosed by a lower wall plate 34 which slopes downwardly toward the center of the unit 10 and by an upper wall plate 36, which plate 36 has an annular enlarged boss 38 in which air baffles 40 are formed about the lower inner periphery thereof. The plenum chamber 28 communicates through a baffle plate 44 with air chamber 46, the air chamber 46 lying within the shell immediately below the vacuum pump 14 and communicating with said pump through apertures 48. Thus, operation of the vacuum pump 14 by the electric motor 16 cause air to be drawn from the air chamber 46 and vented to the ambience through vents 15 in the pump 14. An air stream is thereby caused to be drawn through the nozzle opening 30 and into the plenum chamber 28 due to the vacuum being continuously created within the air chamber 46. When the unit 10 is disposed in contact with the moist surface 20 and is drawn thereover, the squeegee member 32 acting in concert with the air stream thereby created causes water to be entrained within the air stream, the water-/air mixture thus formed entering the plenum chamber 28. The water/air stream slows down on entry into the plenum chamber 28 due in part to the expansion of the stream into the larger volume (relative to the throat of the nozzle opening) of the chamber. The velocity decrease of the water/air stream as well as the action of the baffle 40 and the baffle plate 44 causes the heavier water in the stream to separate out and fall to the lower portion of the plenum chamber 28, the downward slope of the lower wall plate 34 causing the water to collect centrally therein. The fluid stream from which virtually all liquid water has been removed is then vented from the unit 10 through the vacuum pump 14. Water separated from the air stream by the baffle plate 44 falls downwardly and flows into the plenum chamber 28 through an aperture 50 formed in the upper wall plate 36. The baffle plate 44 can particularly take the form of a perforated cone 42 which surmounts the interior portion of the upper wall plate 36 inside of the boss 38, the chamber thereby defined essentially serving as a final water separation chamber.

The electric motor 16 is fitted with an elongated rotary shaft 52 which directly drives the vacuum pump 14 and extends through the pump 14 to a point therebelow. The shaft 52 is journaled at its upper end and near its lower end by bearings 54 and 56, respectively. The lower end of the shaft 52 is fitted with a pinion gear 58 which engages a drive gear 60 formed on the upper end of a shaft 62. The shaft 62 is journaled for rotation by a plurality of conventional bearings, the shaft 62 being vertically oriented. The lower end of the shaft 62 connects to and drives a water pump 64 which is centrally disposed in the lower portion of the plenum chamber 28 at the locus where water separated from the water/air stream collects as aforesaid. The shaft 62 extends through aligned apertures in the baffle plate 44 and in the upper wall plate 36. Water collected in the lower portion of the plenum chamber 28 enters the pump 64 through an aperture 66 communicating with the center thereof and is discharged on operation of the pump 64 through a discharge pipe 68, the pipe 68 communicating with the pump 64 in a known fashion and its inner end. The pipe 68 further extends through the aperture 50 in the upper wall plate 36, through an aperture 70 in the baffle plate 44, and finally to the ambience through an aperture 72 in the housing shell 10. A right angle or other connection 74 allows communication of the pipe 68 with a flexible hose 76, water pumped through the pipe 68 being delivered by the hose 76 to a sump, drain, or storage tank remote from the unit 10.

Figure 3:
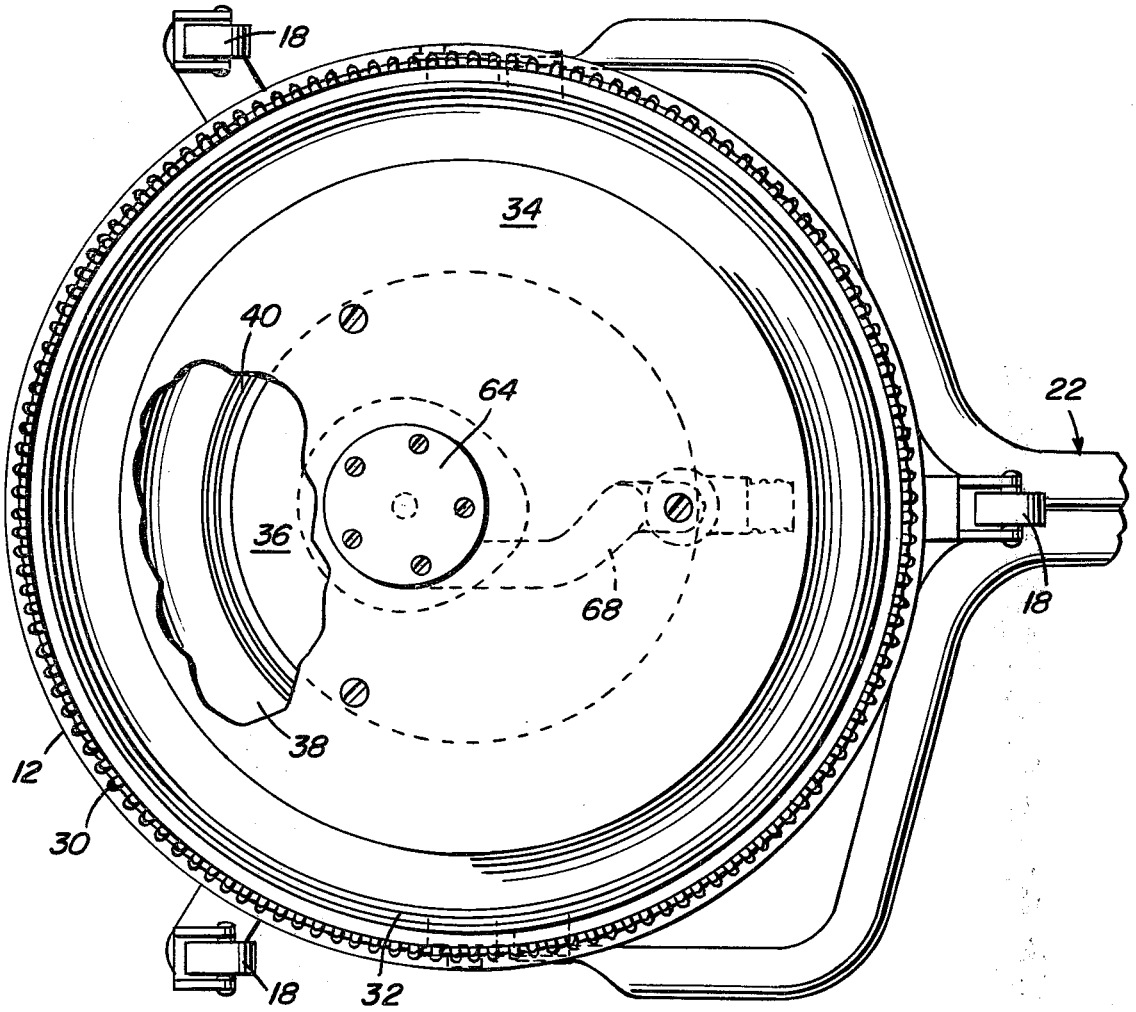
FIG. 3 is a bottom plan view, partially cut away, of the underside of the apparatus of FIG. 1.

Referring now to FIG. 3, the housing shell 10 is seen to be hemispherical in the embodiment shown, the nozzle opening 30 and the squeegee member 32 being substantially annular. However, the shell 10 could be otherwise formed. In particular, the opening 30 could be essentially linear, the squeegee member 32 also being linear and being mounted therealong for unidirectional operation of the drying apparatus.

Figure 4:
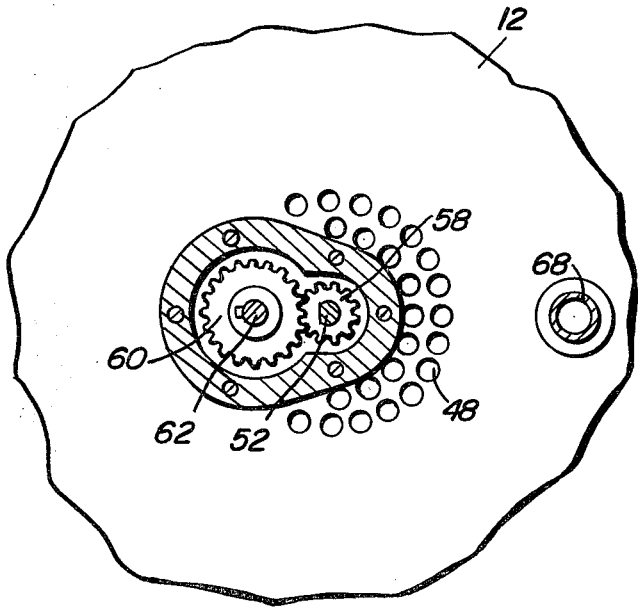
FIG. 4 is a detailed sectional view of a portion of the apparatus taken along section line 4—4 of FIG. 2.

FIG. 4 particularly illustrates the gears 58 and 60 fitted on shafts 52 and 62, respectively. In order to most efficiently operate the vacuum pump 14 and the water pump 64 from the same prime mover, i.e., the electric motor 16, the pumps 14 and 64 must be driven at differing speeds. Thus, the gears 58 and 62 allow "gearing down" of the shaft 62 so that the water pump 64 can be operated at a more optimum speed. The vacuum pump 14 and the water pump 64 can preferably be of the centrifugal type, the separate pumps being disposed within the unit 10 and driven in such a manner so that maximum efficiency is obtained with low power pumping apparatus, thereby resulting in low fabrication costs and low operating costs. Larger units are contemplated in which internal combustion engines will power the pumps and also a self-propelled vehicle with water storage tank. The water is separated from the air due to the reduction in velocity as the mixture enters the plenum chamber and the flow becomes more laminar. The air passing through the baffles is further dried and may be diverted back to the squeegee pickup area to further increase pickup efficiency. The arrangement of the air intake nozzle and squeegee produces a non-laminar flow to increase the pickup efficiency.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Floor drying apparatus, comprising:

a shell defining a plenum chamber within a lowermost portion thereof;

means carried on the shell for drawing a vacuum within the plenum chamber;

nozzle means for communicating the plenum chamber to ambient surroundings, said nozzle means being carried on the shell at a lowermost portion thereof and being spaced from the surface of a floor to be dried for withdrawal of stream of liquid and gas from said floor, the stream being directed into the plenum chamber;

means for seaparating the liquid from the gas in said stream, the liquid collecting temporarily in the plenum chamber and the gas being withdrawn from the apparatus by the vacuum drawing means;

liquid pump means disposed in a lower portion of the plenum chamber for discharging the liquid in the plenum chamber from the apparatus;

a single prime mover for driving both the vacuum drawing means and the liquid pump means;

resilient squeegee means mounted adjacent to the nozzle means for increasing flow of the stream of liquid and gas into the nozzle means, the nozzle means forming an annular opening in a lower portion of the shell, the squeegee means further comprising an annular body of resilient material attached at its upper end about the inner periphery of said opening, the annular body extending downwardly from the opening to contact the floor along the lower edge of the annular body; and wherein the shell comprises a lower wall member which forms the lower wall of the plenum chamber, the apparatus further comprising an annular boss member disposed within the shell and having an arcuate wall portion, an upper plate member centrally disposed between the arcuate wall portion of the boss member and partially defining the plenum chamber, the boss member and the lower wall plate member substantially defining the plenum chamber, the nozzle means directing the stream into the plenum chamber along the arcuate wall portion of the annular boss member, the direction of movement of the stream thereby being altered by the curve of the arcuate wall portion to produce laminar characteristics in the stream, the heavier liquid being disentrained from the gas flow and falling to the bottom of the plenum chamber.

2. The apparatus of claim 1 wherein said separating means comprise baffle means spaced between the vacuum drawing means and the plenum chamber.

3. The apparatus of claim 2 wherein said baffle means comprise a conical plate having perforations formed therein to allow passage of gas therethrough.

4. The apparatus of claim 1 and further comprising means for mounting the shell above the surface of the floor for lateral translation over the floor.

5. The apparatus of claim 1 wherein the vacuum drawing means comprises a vacuum pump attached to an uppermost portion of the shell.

6. The apparatus of claim 5 wherein the prime mover comprises a motor, the apparatus further comprises a first rotary shaft driven by the motor, the first shaft being drivingly connected to said vacuum pump and having a first gear attached to a lower end thereof, a second shaft having a second gear on its upper end, the first gear mating with said second gear to drive the second shaft, the second shaft driving said liquid pump means, and bearing means for journaling said shafts for rotation.

7. The apparatus of claim 1 wherein the lower wall plate member slopes downwardly from the outer periphery thereof toward the center of said lower wall plate member, the liquid thereby temporarily collecting at this lowermost portion of the plenum chamber.

8. The apparatus of claim 7 wherein the liquid pump means is disposed on the lower wall plate member at the center thereof.

9. The apparatus of claim 1 wherein portions of the boss members mounting the upper plate member have apertures formed therein to baffle the stream in the plenum chamber.

10. The apparatus of claim 9 and further comprising a conical member disposed within the shell and mounted therein is surmounting spaced relation to the portions of the boss member having the apertures formed therein and to the upper plate member, the conical member having apertures formed therein to further baffle the flow of fluid through the apertures in the boss member.

11. The apparatus of claim 10 wherein an upper portion of the shell and the conical member define an air chamber, the vacuum drawing means drawing a reduced pressure condition within the air chamber to vent the fluid therein to ambient.

* * * * *